United States Patent [19]

Terashima

[11] 3,958,876

[45] May 25, 1976

[54] MULTICOLOR REPRODUCING APPARATUS

[75] Inventor: Isamu Terashima, Hitachi, Japan

[73] Assignee: Hitachi, Ltd., Japan

[22] Filed: Nov. 4, 1974

[21] Appl. No.: 520,909

[30] Foreign Application Priority Data

Nov. 7, 1973 Japan ..... 48-124513

[52] U.S. Cl. ..... 355/4; 355/16; 96/1.2

[51] Int. Cl.[2] ..... G03G 15/01; G03G 15/10

[58] Field of Search ..... 355/4, 16, 14; 96/1.2

[56] References Cited

UNITED STATES PATENTS

| | | | |
|---|---|---|---|
| 3,115,075 | 12/1963 | Alexander | 355/16 X |
| 3,318,213 | 5/1967 | Kowalski | 355/14 |
| 3,574,456 | 4/1971 | Grace | 355/4 |
| 3,779,639 | 12/1973 | Tamai | 355/4 |

*Primary Examiner*—Robert P. Greiner
*Attorney, Agent, or Firm*—Craig & Antonelli

[57] ABSTRACT

There is disclosed a multicolor reproducing apparatus, wherein a developing unit is maintained in a stationary position, while developing troughs in the developing unit are shifted to a given position for selecting a developing color, and development is effected by transporting a sensitive paper to the developing through.

10 Claims, 2 Drawing Figures

MULTICOLOR REPRODUCING APPARATUS

BACKGROUND OF THE INVENTION

This invention relates to a multicolor reproducing apparatus, and more particularly to a reproducing apparatus of the type wherein a sensitive paper is subjected to plural cycles of exposure and developing processes, whereby a copy of a multicolored image is obtained.

DESCRIPTION OF THE PRIOR ART

The coloring in the color reproduction according to an electrofax method, in most cases, resorts to a combination of yellow, magenta and cyan. For this reason, a colored original image is subjected to color decomposition by means of filters, and for each color thus decomposed, exposure and development are effected. In case plural cycles of exposure and development are applied to a single original image for obtaining a copy of an colored image, failure in register of colors must be avoided. To avoid the improper register of colors, a sensitive paper must be maintained in a stationary position for a duration in which exposure and development are cyclically effected. To this end, there has been proposed a method in which a developing unit is shifted along a stationary sensitive paper. This method, however, entails a mechanism for driving the multicolor developing unit which is complicated in construction and involves a problem that moving speed of the developing section is limited, resulting in the failure to insure consistent shifting of the developing unit. To cope with the above method, another method has been proposed in which a developing unit remains stationary and only the sensitive paper, which has been subjected to the first color exposure, is transported to a developing unit for the first color development and then returned to the exposure position for a subsequent exposure. The method, however, is impractical, because of the difficulty in obtaining proper register of colors.

SUMMARY OF THE INVENTION

It is accordingly an object of the present invention to provide a multicolor reproducing apparatus which is simple in construction and free from improper register of colors.

Another object of the present invention is to provide a multicolor reproducing apparatus, wherein a driving mechanism is simple in construction.

A further object of the present invention is to provide a multicolor reproducing apparatus, wherein a processing time may be shortened.

A still further object of the present invention is to provide a multicolor reproducing apparatus, wherein a developer feeding mechanism is simple in construction.

A still further object of the present invention is to provide a paper feeding mechanism for use in a multicolor reproducing apparatus, wherein a sensitive paper is used to its full extent.

According to the present invention, there is provided a multicolor reproducing apparatus characterized in that the apparatus comprises a developing unit having therein a plurality of developing troughs and maintained in a stationary position to which a sensitive paper is to be transported; and a developing trough driving mechanism provided for selectively shifting the developing troughs to a sensitive paper transporting passage; the sensitive paper being reciprocated by means of a belt between an exposing position and the developing unit.

DETAILED DESCRIPTION OF THE INVENTION

Figure 1:
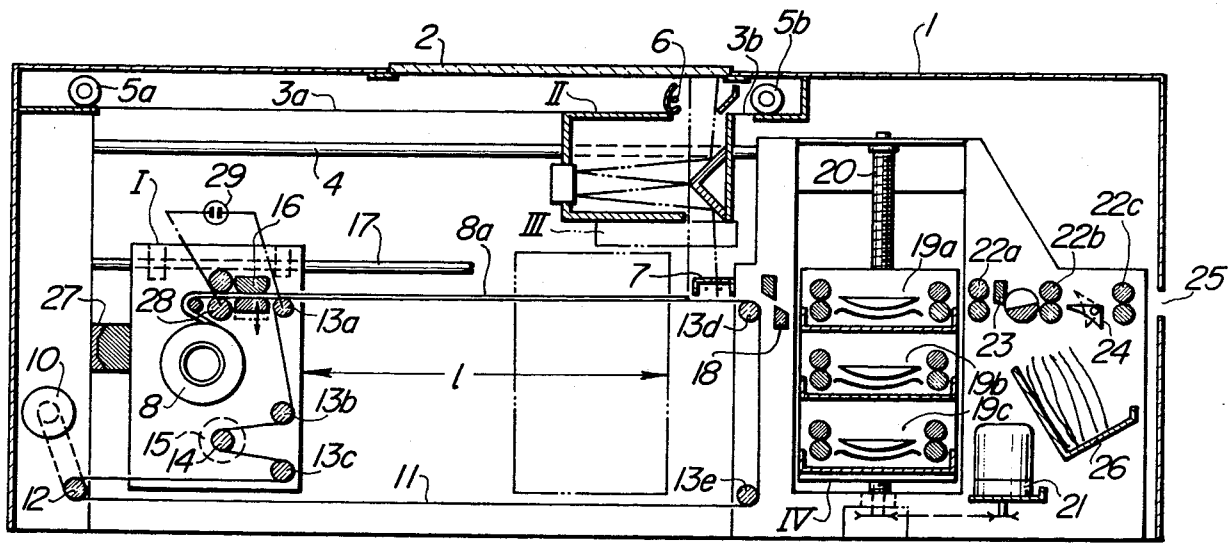
FIGS. 1 and 2 are respectively longitudinal cross-sectional elevational views of embodiments of a multicolor reproducing apparatus according to the present invention.

Referring to FIG. 1, shown at I is a sensitive paper feeding unit, which functions to pay off a sensitive paper by a predetermined length on a belt. Shown at II is an optical system unit, which functions to form an optical image on the surface of sensitive paper by lights from a lamp 6. Designated by III is a filter unit, which involves therein red, blue and green filters for use in decomposing reflected lights into those three colors according to developing colors. Designated by IV is a developing unit, wherein plural developing troughs 19a to 19c are arranged vertically in multi-staged relation to one another, respective developing troughs containing therein a developer of cyan, magenta and yellow which are subtractive complementary colors of filters respectively.

Shown at 1 is a casing of a reproducing apparatus, at 2 an original document support on which an article to be reproduced is rested, and at 3a and 3b, light shielding curtains for interrupting external light, which are housed in roll housings 5a and 5b, Shown at 4 is a rod for the optical system which supports the optical system unit slidably. The optical system unit II and the light shielding curtains 3a and 3b are driven along the rod 4 by means of a wire rope not shown. Designated by 7 is a corona charger which is movable along a sensitive paper 8a for uniformly charging the surface of the sensitive paper. Shown at 8a is a sensitive paper paid off onto a belt from a roll of sensitive paper 8 set in the sensitive paper feeding unit I. Shown at 10 is a main motor which drives the endless belt 11 engaging a driving roller 12. Shown at 14 is a brake roller directly connected with an electromagnetic brake 15. The endless belt 11 is trained about guide rollers **13*a* to 13*c* and brake roller 14 which are all mounted on the paper feeding unit I, and guide rollers 13*d*, 13*e* and driving roller 12 which are mounted on the casing 1 of the reproducing apparatus. Designated by 16 is a sensitive paper clamping device which has a relatively wide area and whose lower portion is vertically movable for clamping or releasing a sensitive paper. Shown at 17 is a rod for the paper feeding unit I which is mounted on the casing 1 and supports the paper feeding unit I slidably. Shown at 19*a* to 19*c* are developing troughs housed in the developing unit IV, and at 20 a threaded shaft which moves the developing troughs 19*a* to 19*c* vertically due to rotation of a developing trough lifting motor 21, so that any developing trough containing therein a developer of a desired color may be selectively shifted to the sensitive paper transporting passage. Designated by 22*a* to 22*c* are paper delivery rollers, which are connected to the guide roller 13*d* in a manner to rotate in synchronism with a travelling speed of the belt 11. Shown at 18 is a cutter for shearing and separating from the paper feeding unit I a reproduced image bearing sensitive paper which has been subjected to the final color development, and at 23 a cutter for shearing and separating a clamping allowance from the reproduced image bearing sensitive paper. Designated by 24 is a paper separation guide which is turned to assume a position shown by a dotted line in FIG. 1 for parting a reproduced image bearing, effective sensitive paper from a clamped portion of the sensitive paper. Shown at 26 is a tray for receiving the clamped portion thus parted from the reproduced image bearing sensitive paper, and at 25 a paper delivery port for discharging the reproduced image bearing, effective sensitive paper to the outside of the apparatus. Shown at 28 is a paper feeding roller, which is connected by way of a clutch 29 to the guide roller 13a in a manner to rotate in synchronism with a travelling speed of the belt 11. The paper feeding unit I is maintained stopped exactly in a stop position through the engagement with a stopper 27. To prevent disengagement of the paper feeding unit I from the stopper 27 due to reaction of the belt 11, current is applied to a solenoid (not shown) of a plunger (not shown), so that the paper feeding unit I may be attracted to the stopper 27** due to an attractive force of the plunger.

In operation, when the motor 10 is rotated, the belt 11 will be rotated by way of the driving roller 12. By this time, current is being fed to the clutch 29 and rotation of the driving roller 12 is transmitted to the paper feed roller 28 so that the sensitive paper 8a will be fed on the belt. After a predetermined length of the sensitive paper is fed onto the belt, the clutch 29 is rendered open, and the sensitive paper clamping device 16 in turn is actuated to clamp the sensitive paper 8a. After a short while, the motor 10 is stopped. Subsequently, the corona charger 7 is caused to travel along the sensitive paper **8*a* for uniformly charging to the entire surface of the sensitive paper, after which the lamp 6 in the optical system unit II is lit and a filter of the first color, for example, a blue filter, in the filter unit III is set in the light passage and caused to travel for exposure. When the entire surface of the sensitive paper has been exposed to the light, the optical system unit II and the filter return to the original position shown in FIG. 1. Then, current flowing to the solenoid of plunger is interrupted, to thereby disengage the stopper 27 from the paper feeding unit I. At the same time, the brake 15 is operated and the motor 10 is rotated so that the sensitive paper feeding unit I is shifted with the sensitive paper clamping device 16 along the rod 17 towards the developing unit IV by the movement of the belt 11. During the movement of the clamping device 16, the sensitive paper 8*a* on the belt and having thereon a latent image of blue component parts from the belt 11 at the guide roller 13 and passes through the developing trough 19*a* which is located on the extension of the upper horizontal part of the belt 11** and containing therein toner of yellow which is a subtractive complementary color of blue. After the sensitive paper feeding unit I has completed the travel of a given distance *l*, it returns to the original position by reverse rotation of the motor 10 and engages with the stopper 27. Thus the first color development is completed.

Then, the brake 15 is released and the motor is rotated in normal direction while the paper clamping device 16 is kept clamping the sensitive paper and the paper feeding unit I is kept in engagement with the stopper 27, so that only the belt 11 will travel in the paper feeding direction so as to arrange the sensitive paper 8a on the belt 11. Then, the motor 10 is stopped, and the surface of sensitive paper is charged with static electricity and exposed to light by means of the filter of second color, followed by the development in the manner described. By this time, in the developing unit IV, the developing trough **19*a* has been replaced by the developing trough 19*b* containing toner of a subtractive complementary color of the second color filter, due to rotation of the motor 21. In the final color developing process, when the sensitive paper feeding unit I and the sensitive paper clamping device 16** reach the terminal point in a given travelling distance *l*, the cutter 18 is operated to cut the reproduced image bearing sensitive paper **8*a* from the roll of sensitive paper 8 housed in the sensitive paper feeding unit I. At that time, the brake 15 is released to stop the sensitive paper feeding unit I. Yet, the motor 10 still remains rotated, so that the reproduced image bearing sensitive paper will be transported towards the paper delivery port 25. During the transportation of the reproduced image bearing sensitive paper towards the paper delivery port 25, an unnecessary marginal portion of the reproduced image bearing sensitive paper which corresponds to a distance from the position of the cutter to the left-hand end (as viewed in FIG. 1) of the developing trough 19*c* is cut away by the cutter 23. The unnecessary marginal portion thus cut is dropped towards the tray 26 by turning the separation guide 24 to the position shown by a dotted line in FIG. 1, while the reproduced image bearing, effective portion of sensitive paper is discharged through the paper delivery port 25** to the outside of the apparatus.

Figure 2:
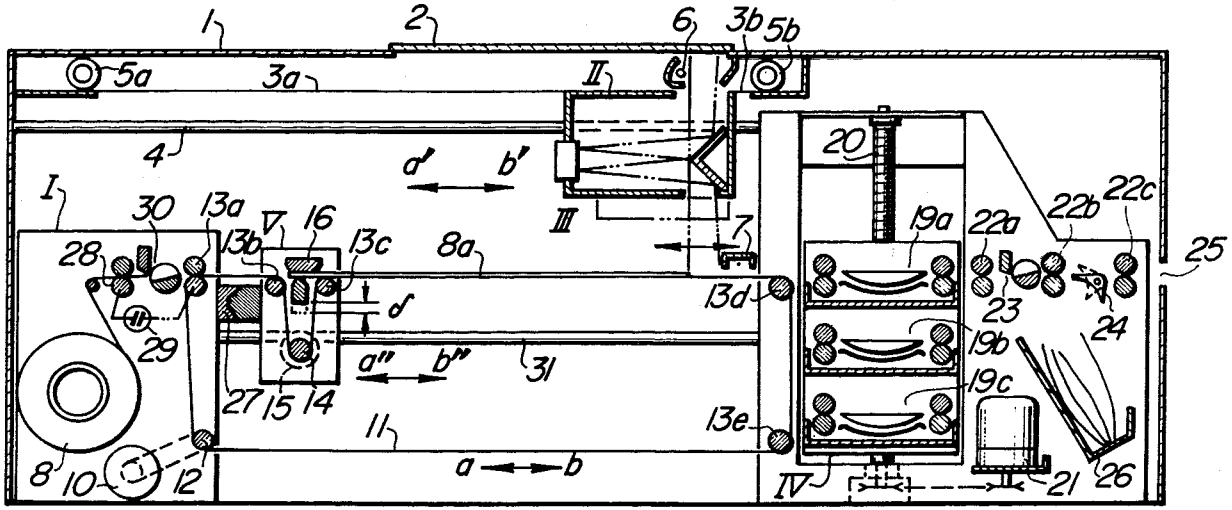

Referring to another embodiment shown in FIG. 2, the second embodiment is discriminated from the first embodiment in the point that the sensitive paper clamping unit V is provided separately from the sensing paper feeding unit and is movable for developing, with the sensitive paper feeding unit I maintained stationary in the position shown in FIG. 2, although, in the first embodiment, both the sensitive paper feeding unit I and the sensitive paper clamping device 16 are shifted altogether for development. To this end, the rod 17 for paper feeding unit and the cutter 18 are omitted in the second embodiment, and in turn there are provided a paper feeding cutter 30 and rod 31 for slidably supporting the sensitive paper clamping unit V.

In operation, if the starting switch is thrown, then the motor 10 is rotated to cause the belt 11 to travel in the direction of *a* shown in FIG. 2. By this time, current is fed to the clutch 29, so that the sensitive paper feed roller 28 will be rotated in synchronism with a travelling speed of the belt 11, whereby the sensitive paper **8*a* is fed by a predetermined length onto the belt 11 from the roll of sensitive paper 8. The sensitive paper clamping unit V still remains in engagement with the stopper 27. When the sensitive paper 8*a* has been completely paid off from the roll of sensitive paper onto the belt 11 by a length of an effective reproducing size plus a clamped portion or allowance, then the paper feed cutter 30 is operated to cut the sensitive paper 8*a* from the roll of sensitive paper 8, and at the same time, the clutch 29 is rendered open. When the trailing edge of sensitive paper 8*a* reaches the sensitive paper clamping device 16 due to the travel of the belt 11, then the sensitive paper clamping device 16 is actuated to clamp the trailing edge of sensitive paper 8*a* from below and above. At that position, the belt 11 stops, and the sensitive paper 8*a* is uniformly charged by means of the corona charger 7, after which the lamp 6 is lit and the optical system unit II is caused to travel. At this time, the spectral filter of the first color is set in a position of intercepting the light path, so that an optical image thus decomposed will be formed on the surface of sensitive paper 8a.** Upon termination of the exposure, the optical system unit II is inverted to travel in the direction of *b'* into the home position shown in FIG. 2. At the time of the inversion of the optical system unit II, the brake 15 is operated to lock the belt 11, and in turn, the motor 10 is rotated. Thus, the sensitive paper clamping unit V is shifted in a state of being nipped by the belt 11 in the direction of *b''* along the belt 11 due to rotation of the motor 10, and the sensitive paper 8*a* parts from the belt 11 at the guide roller 13*d* and alone enters the developing trough 19*a* containing therein toner of a subtractive complementary color of the first filter and pre-set in the developing position. When the sensitive paper clamping unit V comes near to the developing unit IV, the motor 10 is reversed, so that the sensitive paper clamping unit V, withdrawing the sensitive paper 8*a* from the developing trough 19*a*, will be returned to the position at which the unit V engages the stopper 27. After the sensitive paper clamping unit V has been brought into engagement with the stopper 27, the brake 15 is released, and the belt 11 is moved in the direction of *a* by the motor 10. Thus, the sensitive paper 8*a* is rearranged in place on the belt 11. Then, rotation of the belt 11 is stopped, and a subsequent process for the second color reproduction is effected in the same manner as described. By this time, the second filter is set in the position and in the developing unit IV, the developing trough 19b containing a developer of the second color is set in the developing position by the actuation of the developing trough lifting motor 21. The above-described steps are cyclically effected for reproduction with cyan, magenta and yellow. In some cases, black may be added for imparting a shadow. In the reproduction of the final color, after termination of the exposure, the motor 10 is rotated to cause the belt 11 to travel in the direction of *a*, with the sensitive paper clamping unit V maintained in engagement with the stopper 27. At this stage, the paper clamping device 16 is released, so that the sensitive paper 8*a* alone will be transported to the developing unit. In the developing unit the sensitive paper is subjected to the final color development and then dicharged to the outside of the reproducing apparatus through the sensitive paper delivery port 25. When the rear end of the effective area of the sensitive paper 8a comes to the cutter 23, then the cutter is operated to cut the clamped portion of sensitive paper from the reproduced image bearing, effective area of the sensitive paper. At this time, the paper separation guide 24 is turned to the position shown by a dotted line in FIG. 2, whereby the clamped portion of sensitive paper is received in the tray 26, while the reproduced image bearing, effective sensitive paper alone is delivered through the paper delivery port 25 to the outside of the apparatus.

According to the present invention, development is effected by shifting the sensitive paper clamping device. This permits a high speed operation as well as contributes to reducing the capacity of the motor. This advantage is particularly noticeable in the second embodiment in which the small sized, light paper clamping unit alone is shifted. Furthermore, to maintain the developing unit stationary results in the simplified liquid circulating system including piping system. An area of unuseful portion of sensitive paper (a clamped portion) is reduced, with the reduction in expense for a sensitive paper, as well as with the less trouble in the paper delivery. In this point, the first embodiment is particularly advantageous, in which an area of sensitive paper which has been clamped in a preceding reproduction is served for an image reproducing effective area in a succeeding reproduction.

What is claimed is:

1. In a multicolor reproducing apparatus, wherein a single sheet of photoconductive sensitive paper is repeatedly subjected to plural cycles of charging, exposing and developing steps, the improvements comprising:

a belt for transporting the sensitive paper;

means for driving said belt with a part of the belt being maintained horizontally and flatwise over a given distance;

sensitive paper feeding means for paying off a sensitive paper from one end of the horizontal portion of said belt to place the same on the surface of said horizontal portion of belt;

sensitive paper clamping means for clamping the sensitive paper on said horizontal portion of belt and being movable along said horizontal portion of belt;

means for positioning said sensitive paper clamping means at an exact position for exposing;

a developing unit provided on the extension of said horizontal portion of belt on the opposite side of said sensing paper feeding means;

a charger and an exposing device respectively movable along said horizontal portion of belt; and wherein said means for positioning maintain said sensitive paper at said exact position for charging and exposing said sensitive paper to a predetermined color by said charger and exposing device respectively moving along said horizontal portion of said belt, said driving means driving said belt and said sensitive paper clamping means toward said developing unit after said charging and exposing operations such that said sensitive paper is respectively developed in a predetermined developer corresponding to said predetermined color, and wherein said means for positioning repositions said sensitive paper at said position after said developing operation such that said charging, exposing and developing operations are successively repeated with different predetermined colors and developers until a final multicolor image is formed on said sensitive paper.

2. In a multicolor reproducing apparatus, wherein a single sheet of photoconductive sensitive paper is repeatedly subjected to plural cycles of charging, exposing and developing steps, the improvements comprising:

a belt for transporting the sensitive paper;

means for driving said belt with a part of the belt being maintained horizontally and flatwise over a given distance;

sensitive paper feeding means for paying off a sensitive paper from one end of the horizontal portion of said belt to place the same on the surface of said horizontal portion of belt;

sensitive paper clamping means for clamping the sensitive paper on said horizontal portion of belt and being movable along said horizontal portion of belt;

means for positioning said sensitive paper clamping means at an exact position for exposing;

a developing unit provided on the extension of said horizontal portion of belt on the opposite side of said sensing paper feeding means;

a charger and an exposing device respectively movable along said horizontal portion of belt; and wherein said means for positioning maintain said sensitive paper at said exact position for charging and exposing said sensitive paper to a predetermined color by said charger and exposing device respectively moving along said horizontal portion of said belt, said driving means driving said belt and said sensitive paper clamping means towards said developing unit after said charging and exposing operations such that said sensitive paper is respectively developed in a predetermined developer corresponding to said predetermined color, and wherein said means for positioning repositions said sensitive paper at said exact position after said developing operation such that said charging, exposing and developing operations are successively repeated with different predetermined colors and developers until a final multicolor image is formed on said sensitive paper; and wherein said sensitive paper feeding means and sensitive paper clamping means are in one unit and said unit is movable along the horizontal portion of belt.

3. In a multicolor reproducing apparatus, wherein a single sheet of photoconductive sensitive paper is repeatedly subjected to plural cycles of charging, exposing and developing steps, the improvements comprising:

a belt for transporting the sensitive paper;

means for driving said belt with a part of the belt being maintained horizontally and flatwise over a given distance;

sensitive paper feeding means for paying off a sensitive paper from one end of the horizontal portion of said belt to place the same on the surface of said horizontal portion of belt;

sensitive paper clamping means for clamping the sensitive paper on said horizontal portion of belt and being movable along said horizontal portion of belt;

means for positioning said sensitive paper clamping means at an exact position for exposing;

a developing unit provided on the extension of said horizontal portion of belt on the opposite side of said sensing paper feeding means;

a charger and an exposing device respectively movable along said horizontal portion of belt; and wherein said means for positioning maintain said sensitive paper at said exact position for charging and exposing said sensitive paper to a predetermined color by said charger and exposing device respectively moving along said horizontal portion of said belt, said driving means driving said belt and said sensitive paper clamping means toward said developing unit after said charging and exposing operations such that said sensitive paper is respectively developed in a predetermined developer corresponding to said predetermined color, and wherein said means for positioning repositions said sensitive paper at said exact position after said developing operation such that said charging, exposing and developing operations are successively repeated with different predetermined colors and developers until a final multicolor image is formed on said sensitive paper; and wherein said sensitive paper clamping means comprises guide rollers for said belt and paper clamp members, said guide rollers bending the horizontal portion of belt downwards and substantially into U-shape, and at least one of said clamp members being located in the space defined by said U-shape.

4. In a multicolor reproducing apparatus, wherein a single sheet of photoconductive sensitive paper is repeatedly subjected to plural cycles of charging, exposing and developing steps, the improvements comprising:

a belt for transporting the sensitive paper;

means for driving said belt with a part of the belt being maintained horizontally and flatwise over a given distance;

sensitive paper feeding means for paying off a sensitive paper from one end of the horizontal portion of said belt to place the same on the surface of said horizontal portion of belt;

sensitive paper clamping means for clamping the sensitive paper on said horizontal portion of belt and being movable along said horizontal portion of belt;

means for positioning said sensitive paper clamping means at an exact position for exposing;

a developing unit provided on the extension of said horizontal portion of belt on the opposite side of said sensing paper feeding means;

a charger and an exposing device respectively movable along said horizontal portion of belt; and wherein said means for positioning maintain said sensitive paper at said exact position for charging and exposing said sensitive paper to a predetermined color by said charger and exposing device respectively moving along said horizontal portion of said belt, said driving means driving said belt and said sensitive paper clamping means toward said developing unit after said charging and exposing operations such that said sensitive paper is respectively developed in a predetermined developer corresponding to said predetermined color, and wherein said means for positioning repositions said sensitive paper at said exact position after said developing operation such that said charging, exposing and developing operations are successively repeated with different predetermined colors and developers until a final multicolor image is formed on said sensitive paper; and wherein said means for driving a belt includes guide rollers mounted in said sensing paper clamping means, rollers provided stationary on both sides of a travelling zone of said sensing paper clamping means and a motor for driving the belt.

5. A multicolor reproducing apparatus as defined in claim 4, wherein at least one of said guide rollers mounted in said sensing paper clamping means is connected to a braking device.

6. A multicolor reprodicing apparatus comprising:

means for exactly positioning a sensitive paper at an exposing position;

means for charging said sensitive paper at said exposing position;

means for exposing said sensitive paper to a predetermined one of a plurality of different colors at said exposing position, said charging means charging said sensitive paper before each exposure to said different colors, means for developing said sensitive paper for each different color at a developing position after each exposure to said predetermined one of said colors at said exposing position; and means for transporting said sensitive paper between said exposing position and said developing position, said transporting means repeatedly transporting said sensitive paper from said exposing position to said developing position after each exposure to each one of said colors, and said transporting means repeatedly transporting said sensitive paper from said developing position to said exposing position aft after each development until a predetermined multicolor image is produced on said sensitive paper, wherein said means for positioning exactly positions said sensitive paper at said exposing position after each transportion by said transporting means of said sensitive paper from said developing position;

wherein said transporting means includes a movable belt member having a horizontally disposed portion extending at least over a distance from said exposing position to said developing position, clamping means for clamping a portion of said sensitive paper, said clamping means being independently movable with respect to said belt member, and drive means for driving at least one of said belt member and said clamping means.

7. A multicolor reproducing apparatus according to claim 6, wherein said means for positioning positions said clamping means at said exposed position upon said drive means driving said clamping means from said developing position to said exposing position such that said sensitive paper is exactly positioned with respect to said exposing position.

8. A multicolor reproducing apparatus according to claim 7, wherein said drive means drives only said belt member when said clamping means is exactly positioned at said exposing position such that said sensitive paper is maintained flat on said belt member, while said clamping means maintains said sensitive paper exactly at said exposing position by said means for positioning.

9. A multicolor reproducing apparatus according to claim 8, wherein said drive means drives both said belt member and said clamping means between said exposing position to said developing position, such that said sensitive paper is maintained in a fixed relation to said clamping means while being transported between said exposing and developing positions.

10. A multicolor reproducing apparatus according to claim 6, wherein means for discharging said sensitive paper are provided upon the production of said predetermined multicolor image on said sensitive paper.

* * * * *